United States Patent [19]

Gött et al.

[11] 4,093,106

[45] June 6, 1978

[54] APPARATUS FOR DETACHING WIRES CUT TO LENGTH FROM A DISORDERED BUNDLE OF WIRE

[75] Inventors: Hans Gött; Josef Ritter; Klaus Ritter; Gerhard Ritter, all of Graz,, Austria

[73] Assignee: EVG Entwicklungs-u. Verwertungs Gesellschaft mbH, Graz, Austria

[21] Appl. No.: 672,059

[22] Filed: Mar. 31, 1976

[30] Foreign Application Priority Data

Apr. 2, 1975 Austria ..... 2506/75

[51] Int. Cl.[2] ..... B65G 61/00

[52] U.S. Cl. ..... 221/224; 221/277

[58] Field of Search ..... 221/208, 224, 225, 258, 221/267, 277; 214/1 P

[56] References Cited

U.S. PATENT DOCUMENTS

| | | | |
|---|---|---|---|
| 1,674,319 | 6/1928 | Granston | 221/225 |
| 2,380,450 | 7/1945 | Klopper | 221/277 X |
| 3,310,301 | 3/1967 | Netta et al. | 221/277 X |
| 3,373,868 | 3/1968 | Missioux et al. | 214/1 PX |

*Primary Examiner*—Robert B. Reeves
*Assistant Examiner*—Joseph J. Rolla
*Attorney, Agent, or Firm*—Ernest F. Marmorek

[57] ABSTRACT

The invention concerns an apparatus for detaching wires previously cut to length from a disordered bundle. The apparatus includes a container for the bundle of wire in which there is mounted, adjacent one end, a device for grasping the wires in turn adjacent their ends and moving them transversely to their longitudinal axis against a stop situated to the side of the draw-in region of two conveyor rollers which have a variable spacing between their axes. The rollers are arranged, on reducing their axial spacing, to grasp the end of each wire bearing against the stop and to pull that wire out of the bundle substantially in its axial direction to convey it to a receiving device.

8 Claims, 7 Drawing Figures

APPARATUS FOR DETACHING WIRES CUT TO LENGTH FROM A DISORDERED BUNDLE OF WIRE

In order to detach individual wires from bundles of wire and to pass on the separated wires, in order, to a processing machine, it is known, from Austrian Pat. Specification No. 189.890, to use a method in which the wires at the outer circumference of the loose bundle are grasped at a zone which is narrow in proportion to the length of the wire and which is situated close to the middle of the wires, by means of a device which is constructed, for example, in the form of a threaded spindle or a disc with peripheral grooves and which cooperates with a stripper, and by turning the spindle or the disc transversely to the longitudinal direction of the wires they are detached in turn from the bundle at first in the region of the zone, to be then gradually progressively completely separated from the bundle. This detachment process may be aided by combing-out devices brushing along the wires.

With this method, operational disturbances may occur as a result of the fact that, as a result of a particularly disordered arrangement of the wires in the bundle, the device is not in a position to grasp an individual wire. Furthermore, it may happen that a wire which has already been grasped by the device but which is severely jammed in the bundle can only be separated from the bundle with permanent deformation, because, as a result of the device or the following comb acting transversely on the axis of the wire on the one hand and the reaction force at the jamming point on the other hand, such great bending moments are exerted on the wire that the elastic limit of the material is exceeded.

This has a particularly disturbing effect if the separated wires are to be passed-on directly — (that is to say without any storage in an intermediate store) — to a processing machine, because a bent wire can, in some circumstances, lead to serious disturbances in the processing machine, for example a mesh welding machine for producing welded wire mesh.

The present invention relates to an apparatus for detaching wires cut to length from a disordered bundle of wires particularly when supplying wires to a processing machine, with a receiving container for the bundle of wire, in which there engages a device which is capable of grasping the wires and moving them transversely to their longitudinal axis and which cooperates with a stripper, and its object is to avoid the difficulties outlined. It starts from recognition of the fact that the ends of the wire can be grasped considerably more easily than can their central regions and that bending of the wires can be avoided with certainty if the detaching of the wires from the bundle of wires is effected, not, as hitherto, in the direction transverse to the axis of the wire but substantially in the axial direction.

According to the present invention the apparatus comprises a container for the bundle of wire, in which there is mounted adjacent an end of the container a device for grasping the wires in turn adjacent their ends and moving them transversely to their longitudinal axis against a stop situated to the side of the draw-in region of two conveyor rollers which have a variable spacing between their axes and which are arranged, on reducing their axial spacing, to grasp the end of the wire bearing against the stop, and to pull the wire out of the bundle substantially in its axial direction to convey it to a receiving device.

The grasping device may be constructed in known manner as a threaded spindle, the axis of the threaded spindle being inclined in such a direction in relation to the longitudinal axis of the receiving container that, in the region of engagement with the wires, the threads extend parallel to the longitudinal axis of the receiving container, as a result of which the grasping of the ends of the wire by the threads is considerably aided.

The apparatus may include a receiving device for the separated wire advantageously consisting of a substantially "V"-shaped guideway. In order to bring the particular wire conveyed into the receiving device precisely into the correct position for immediate passing on to a processing machine, for example a wire-mesh welding machine, the receiving device for the separated wire may be provided at its end remote from the conveyor rollers with an adjustable end stop and at the end adjacent to the conveyor rollers with a rebound stop for the particular wire separated.

The receiving device for the separated wire may be constructed either so that it itself is capable of passing on the wire supplied to it directly to a processing machine or so that the wire is taken from it by the processing machine's own feed device.

In the former case, the receiving device for the separated wire may be constructed for pivoting about an axis parallel to its longitudinal axis, and in the latter case it may be composed of a plurality of like elements which are disposed at intervals and in the gaps between which, feed devices of a processing machine engage.

The invention will now be described with reference to the accompanying diagrammatic drawings in which.

Figure 1:
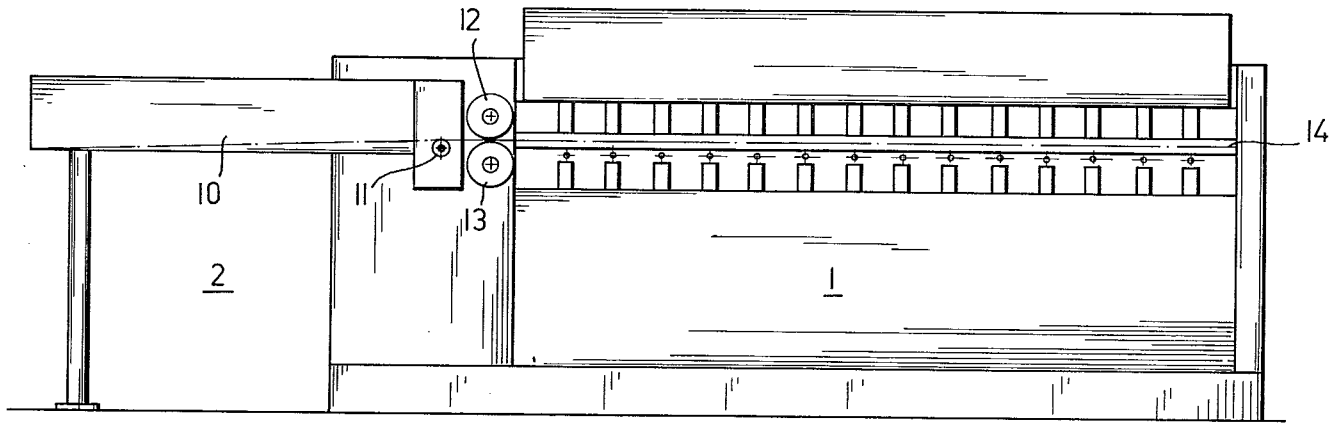
FIG. 1 shows an apparatus according to the invention and a mesh welding machine, in elevation.

FIG. 1 illustrates diagrammatically a mesh welding machine 1 as well as an apparatus 2 which is disposed at the side of the mesh welding machine to detach the transverse wires, cut to length, for the mesh, from a bundle of wires. In particular there can be seen a receiving container 10 in which a bundle of transverse wires is received. At the righthand end of the receiving container 10, a grasping device 11 can be seen in the form of a threaded spindle. Disposed between this and the mesh welding machine are two conveyor rollers 12, 13 which grasp the end of the wire introduced by the grasping device 11 into the roller gap and pull the wire out of the bundle in the direction of the axis of the wire and convey it into the receiving device 14 for the separated wire.

The conveyor rollers 12, 13 may rotate continuously, at least one of them (as indicated, for example, in FIG. 2 by a double arrow P for the conveyor roller 13) being guided for displacement parallel to itself, so that the two rollers can be pushed apart from one another or towards one another again. The actuating mechanism of the rollers, necessary for this, does not form a subject of the invention and therefore need not be described in more detail. Preferably, however, the relative movement of the rollers is controlled from the processing machine 1 so that the wire are supplied to the processing machine as required. This control device may also be of known construction and does not form a subject of the invention.

Figure 2:
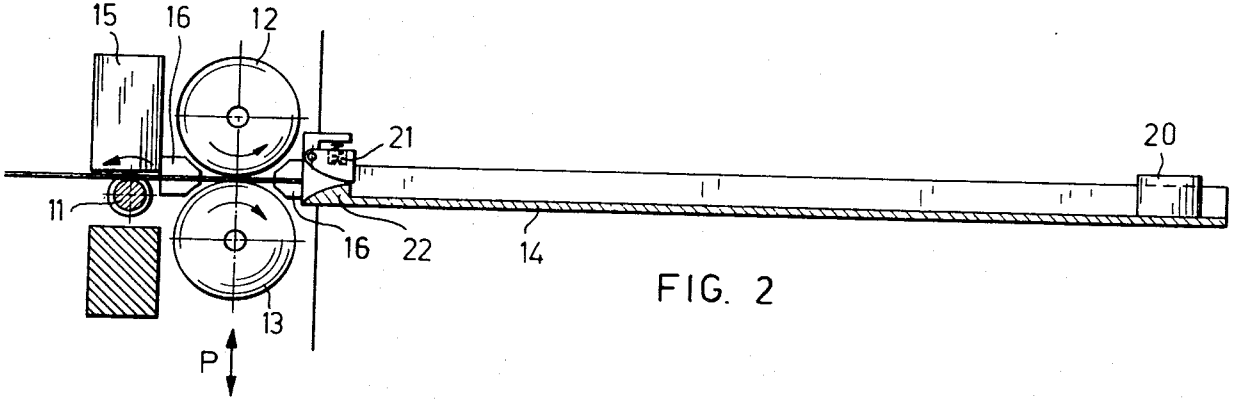
FIG. 2 shows the same apparatus in side elevation, partially in section.

As can be seen, in particular, from FIG. 2, the device 11 cooperates with a stripper 15 and the spatial arrangement of the device 11 and the stripper 15 is such that only a single wire can ever be moved under the stripper 15 by the device 11 and be conveyed against two stops 16 behind this.

Figure 3:
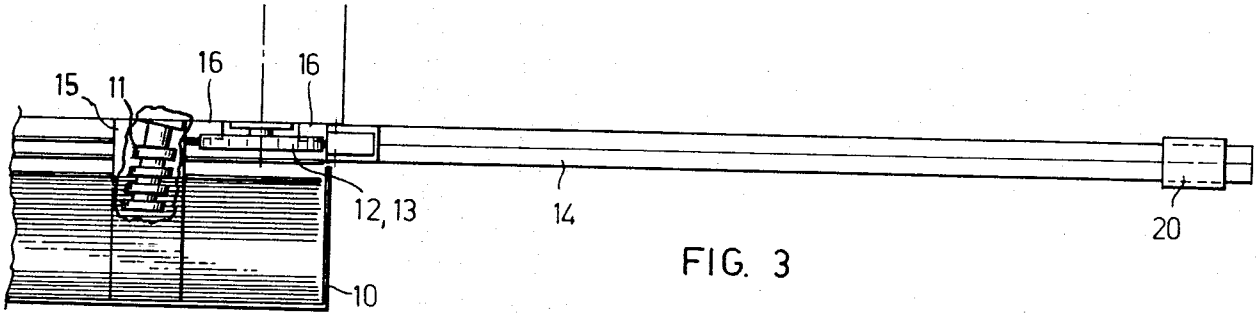
FIG. 3 shows a plan view corresponding to FIG. 2 with a section removed to show a threaded spindle.

In a preferred form a embodiment, the device 11 is constructed in the form of a threaded spindle. As can be seen, in particular, from FIG. 3, the axis of the threaded spindle is then inclined in relation to the longitudinal axis of the receiving container 10 so that the threads extend parallel to the longitudinal axis of the container 10. The wires separated by the device 11 and pulled out of the bundle of wires by the conveyor rollers 12, 13 are conveyed into a receiving device 14. At the end situated remote from the conveyor rollers 12, 13 an end stop 20 is provided in the receiving device 14. This end stop is so constructed that it can be displaced along the receiving device 14 and fixed in any desired position on the receiving device.

Provided at the end of the receiving device 14 immediately adjacent to the conveyor rollers 12, 13 is a rebound stop which prevents the wires conveyed into the receiving device 14 at high speed by the conveyor rollers 12, 13 from rebounding. As can be seen from FIG. 2, this rebound stop consists of a projecting nose 22 at the bottom of the receiving device 14 and a spring pawl 21 cooperating with this nose. As can further be seen from FIG. 2, the pawl 21 projects a short distance beyond the nose 22 in the direction in which the wire is conveyed.

The wire pushed forwards by the conveyor rollers 12, 13, runs against the wedge-shaped faces of the pawl 21 and the nose 22, as a result of which the pawl 21 is lifted. As soon as the wire has been conveyed to its full length into the receiving device 14, the pawl 21 is closed or lowered again by its spring, and the end of the pawl 21 projecting beyond the nose 22 urges the wire into the lowest possible position in the receiving device 14.

Figure 4:
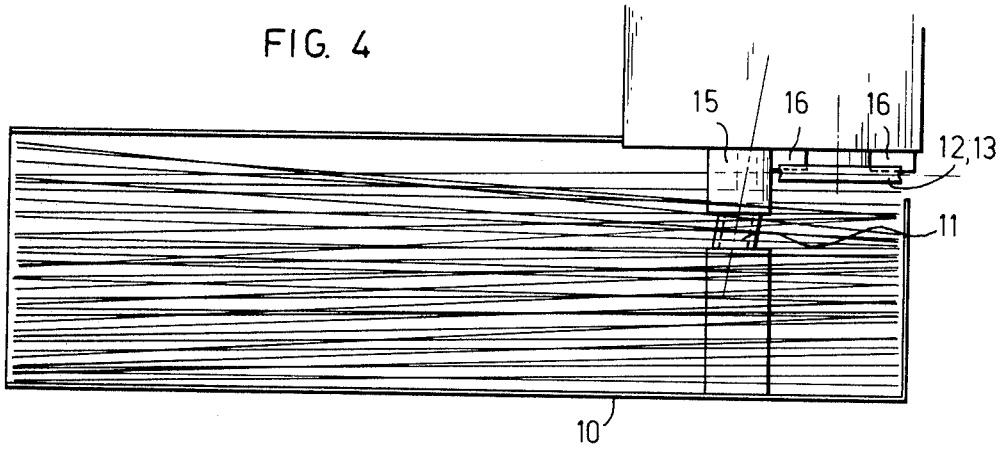
FIG. 4 shows the separation of the wires of a disordered bundle of wire by the apparatus, in plan view.

The separating process is illustrated diagrammatically in FIG. 4. It will be seen how the ends of several wires are conveyed in succession between the conveyor rollers 12, 13 by the grasping device 11. If, as shown by way of example, the device 11 is constructed in the form of a screw spindle, then the end of the screw thread can be disposed in such a position that an individual wire can no longer be conveyed any further at the moment when it bears against the stops 16.

Preferably the drive for the device 11 can be actuated in synchronism with the processing machine 1 to ensure the rhythmic supply of the wires to the processing machine. In order to be able to pass on the separated wires directly to a processing machine, the receiving device 14, extending into the region of the processing machine, can be constructed for rotation about a pin 23 parallel to its longitudinal axis.

Figure 5:
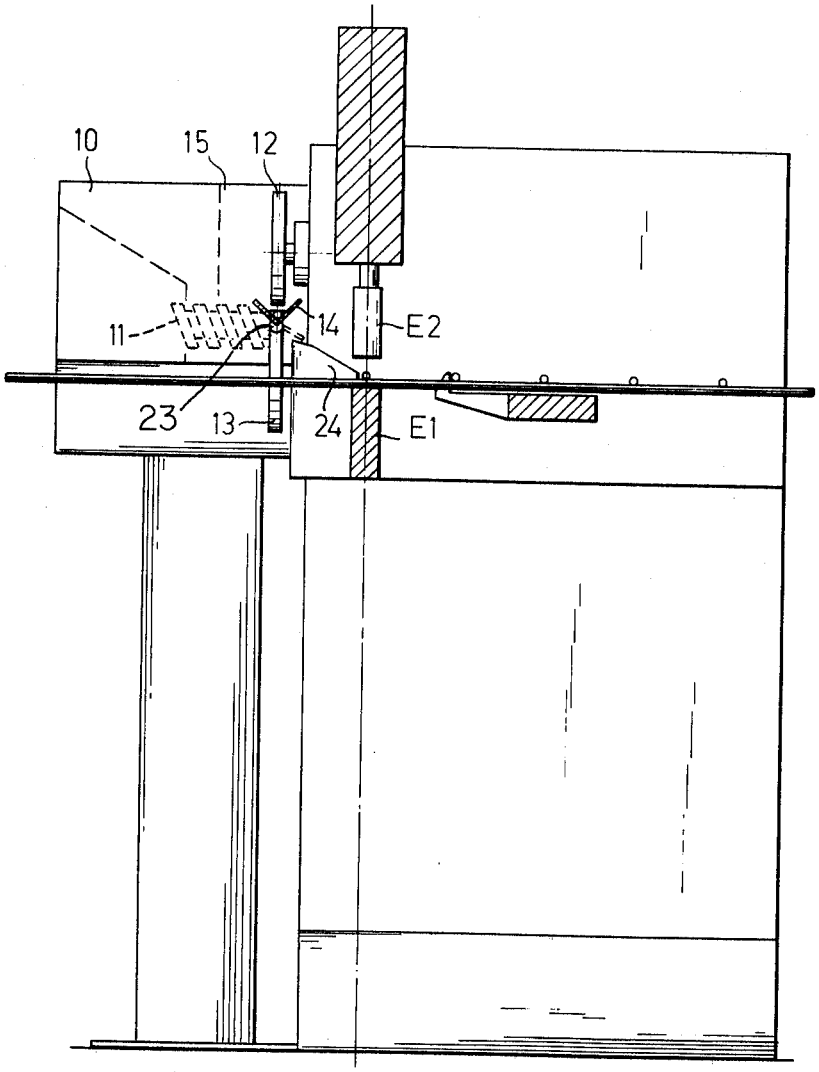
FIG. 5 shows a mesh welding machine, partially in section, together with an apparatus according to the invention; and, FIGS. 6 and 7 show the receiving device for the separated wire in cooperation with feed devices of the mesh welding machine.

As can be seen from FIG. 5, the transverse wires of a mesh welding machine can be conveyed directly between the electrodes E1, E2 of the mesh welding machine, as required by rhythmic rotation of the receiving device 14 about the pin 23, via a runway 24 disposed in the mesh welding machine.

Figure 6:
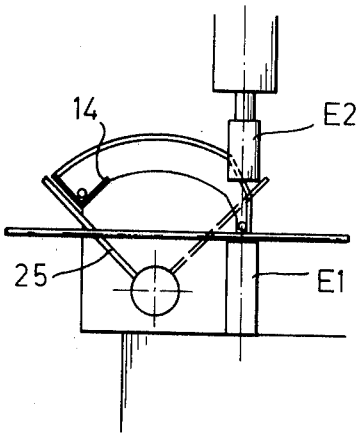
Figure 7:
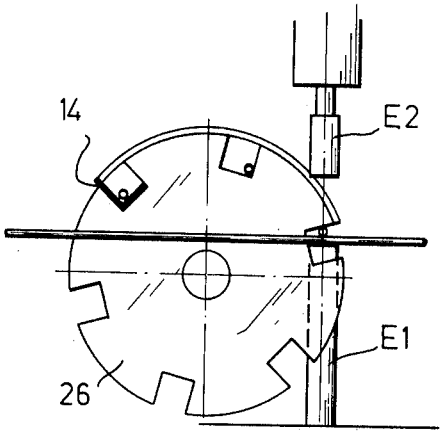

Another possibility for passing on the separated wires to a processing machine, for example a mesh welding machine, consists in forming the receiving device 14 of a plurality of like elements which are disposed with spacing and in the gaps between which, as indicated in FIGS. 6 and 7, feed devices of the mesh welding machine may be disposed in the form of conveyor fingers 25 (FIG. 6) or conveyor discs 26 (FIG. 7).

We claim:

1. An apparatus for detaching wires cut to length from a disordered bundle of wire, the apparatus comprising a container for said bundle of wire, an advancing device for advancing said wires one at a time, said device being mounted adjacent an end of said container and being arranged to move said wires one at a time in a direction transverse to their longitudinal axis against a stop, a pair of conveyor rollers, said conveyor rollers having a variable spacing between their axes and being mounted adjacent said stop, said rollers being arranged to grasp the end of each wire one at a time as it is brought against said stop by said device, and to pull said wire out of said bundle in a substantially axial direction.

2. An apparatus according to claim 1, wherein a stripper is provided adjacent said advancing device to allow only one wire at a time to enter said device.

3. An apparatus according to claim 1, wherein said advancing device comprises a threaded spindle, said spindle having an axis inclined to the longitudinal axis of the container so that the threads of said spindle extend substantially parallel to the longitudinal axis of said container.

4. Apparatus according to claim 1, which further includes a device for receiving an individual separated wire after it has left said rollers.

5. An apparatus according to claim 4, wherein said receiving device comprises an elongate substantially V-shaped guideway.

6. An apparatus according to claim 5, wherein said receiving device includes at its end remote from said conveyor rollers an adjustable end stop, and at its end adjacent said rollers a rebound stop to prevent rebound of each wire received by the receiving device.

7. An apparatus according to claim 4, wherein said receiving device is arranged to pivot about a pin parallel to its longitudinal axis.

8. An apparatus according to claim 4, wherein said receiving device comprises a plurality of like, spaced apart, elements, feed devices of a processing machine being arranged between said elements.

* * * * *